US009198466B2

(12) United States Patent
Liu

(10) Patent No.: US 9,198,466 B2
(45) Date of Patent: Dec. 1, 2015

(54) ELECTRONIC CIGARETTE AND SOFT ABSORPTION STEM THEREOF

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 272 days.

(21) Appl. No.: 13/879,387

(22) PCT Filed: Dec. 28, 2012

(86) PCT No.: PCT/CN2012/087852
§ 371 (c)(1),
(2) Date: Apr. 12, 2013

(87) PCT Pub. No.: WO2014/101114
PCT Pub. Date: Jul. 3, 2014

(65) Prior Publication Data
US 2014/0182610 A1 Jul. 3, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 4,934,524 | A * | 6/1990 | St. Charles | 206/204 |
| 2013/0061861 | A1* | 3/2013 | Hearn | 131/329 |
| 2013/0192617 | A1* | 8/2013 | Thompson | 131/329 |
| 2013/0276802 | A1* | 10/2013 | Scatterday | 131/329 |
| 2014/0014124 | A1* | 1/2014 | Glasberg et al. | 131/328 |

FOREIGN PATENT DOCUMENTS

CN 201767027 U * 3/2011

OTHER PUBLICATIONS

CN201767027 U Translation; Xu, Mingliang; Mar. 2011.*

* cited by examiner

*Primary Examiner* — Richard Crispino
*Assistant Examiner* — Eric Yaary
(74) *Attorney, Agent, or Firm* — Cheng-Ju Chiang

(57) ABSTRACT

A soft absorption stem for an electronic cigarette is provided, comprising a sleeve, a cigar liquid tank disposed inside the sleeve, an atomization device and a liquid guiding component. The sleeve is made of soft material; a plurality of venting slots is extended axially from one end of the sleeve to the other end thereof and disposed on an inner wall of the sleeve; the sleeve includes a mouthpiece end and a connection end; a suction hole communicating with the venting slots is provided on the mouthpiece end; smoke produced by atomization of the atomization device flows out of the sleeve from the venting slots across the suction hole. The electronic cigarette makes the user more comfortable when holding the sleeve in hand and containing in mouth, having more compact internal construction, having unique smoke path, and having increased cigar liquid storage capacity.

14 Claims, 8 Drawing Sheets

ELECTRONIC CIGARETTE AND SOFT ABSORPTION STEM THEREOF

CROSS REFERENCE TO RELATED APPLICATIONS

The present application is a 35 U.S.C. §371 National Phase conversion of International (PCT) Patent Application No. PCT/CN2012/087852, filed on Dec. 28, 2012, the disclosure of which is incorporated by reference herein. The PCT International Patent Application was filed in Chinese.

FIELD OF THE INVENTION

The present invention relates to an electronic cigarette and more particularly relates to an electronic cigarette with a soft enclosure.

BACKGROUND OF THE INVENTION

A prior art absorption stem of an electronic cigarette includes a sleeve, a cigar liquid tank disposed inside the sleeve for storing cigar liquid and an atomization device for atomizing the cigar liquid to produce smoke. An axially extended vent tube is positioned dedicatedly in advance at a middle location of the cigar liquid tank and functions as a smoke path for flowing of smoke.

The following drawbacks exist in a prior art electronic cigarette absorption stem: as the sleeve is made of hard material, it will be less comfortable for the user to hold the sleeve in hand or contain in mouth. As the vent tube is positioned dedicatedly in advance at the middle location of the cigar liquid tank and functions as a smoke path, the internal construction thereof is complicated. In addition, the room of the cigar liquid tank located inside the sleeve which has predefined and constant size, that is, the room for storage of cigar liquid, is relatively small. As such, less cigar liquid will be stored.

SUMMARY OF THE INVENTION

The present invention is to provide a soft absorption stem for an electronic cigarette, making the user more comfortable when holding the sleeve in hand and containing in mouth, having more compact internal construction, having unique smoke path, and having increased cigar liquid storage capacity inside the sleeve space which is maintained relatively unchanged.

To realize the above objection, a soft absorption stem for an electronic cigarette is provided which includes a sleeve with a hollow cavity, a cigar liquid tank disposed inside the sleeve and for storing cigar liquid, an atomization device for transforming cigar liquid into smoke, and a liquid guiding component for guiding cigar liquid contained in the tank to the atomization device. The sleeve is made of soft material. A plurality of venting slots is extended axially from one end of the sleeve to the other end thereof and disposed on an inner wall of the sleeve. The sleeve includes a mouthpiece end and a connection end. A suction hole communicating with the venting slots is provided on the mouthpiece end. Smoke produced by atomization of the atomization device flows out of the sleeve from the venting slots across the suction hole.

Here, the venting slots are formed by recessing of the inner wall of the sleeve in a direction away from an axis. The plurality of venting slots is symmetrical circumferentially about the axis of the sleeve and is arranged on the inner wall of the sleeve.

Here, the cross section of the inner wall of the sleeve is of a circular or polygon. The venting slots have a cross section of arc shape, U shape, V shape or trapezoid shape.

Herein, the soft material is plastic, paper, rubber or fiber material. Herein, the plastic material is selected from any one of the following materials: PC, PP, PVC, ABS, PET or PE. Herein, the paper material is paper having required hardness. Here, the fiber material is fiber tube, wood pulp fiber or glass fiber tube.

Herein, the sleeve is formed by combination of a top wall and a side wall. The top wall is located at the mouthpiece end and is integrally formed with the sleeve. The suction hole is defined in the top wall.

Here, a venting portion is placed between the suction hole and venting slots for interconnecting the two.

Here, the venting portion is a cylinder positioned on an upper end of the cigar liquid tank. The cavity of the venting portion communicates the suction hole. A guiding slot running axially is disposed on a side wall of the venting portion to communicate the cavity of the venting portion with the venting slots.

Herein, the cigar liquid tank is defined by a sealed cylindrical space constituted by a liquid barrel for storage of cigar liquid and an upper cover and a lower cover both of which are sealably disposed at two ends of the barrel. The side wall of the cigar liquid tank is pressed or almost pressed against the inner wall of the sleeve. The two ends of the cigar liquid are connected with the sleeve.

Herein, the liquid barrel is of a cylinder, and the upper cover and lower cover are inserted into the inner wall of the liquid barrel at two ends thereof respectively. The upper cover includes a cylindrical upper cover body, an upper cover bulged rim, which is extended radially outwardly along the side wall of the upper cover body at one end thereof and is pressed against the other end of the liquid barrel, and a venting portion located at an upper end of the upper cover body for communicating the venting slots with the suction hole. The lower cover is of a cylinder and a lower cover bulged rim is provided on the side wall of the lower cover at a bottom end thereof for being pressed against the other end of the liquid barrel. A sealing hole extended axially is defined at a middle portion of the lower cover. The sealing hole has the liquid guiding component accommodated therein to seal the cigar liquid tank.

Herein, a connection component is provided on the connection end of the sleeve for connecting with an external power source in order to provide power to the atomization device and thus make the device works. The connection component is inserted into the sleeve so as to secure the atomization device, liquid guiding component and cigar liquid tank inside the sleeve. The connection component include a connection member which functions as a first electrode of the atomization device and of which one end is inserted into the sleeve for securing the atomization device inside the sleeve, an upper electrode member working as a second electrode of the atomization device, and an insulation ring located between the upper electrode and connection member. The upper electrode member is tightly fastened inside the connection member through the insulation ring.

Herein, the connection member is substantially of a hollow cylinder and includes a cylindrical main body with a larger diameter and a cylindrical connection portion with a smaller diameter. A locating rim is disposed between the main body and connection portion and extends radially outwardly from the main body for matching the connection end of the sleeve. The main body is inserted and secured into the sleeve. An externally threaded connector for connecting with an external power source and an intake hole for air entrance are disposed on the connection portion. A holding groove is defined in the inner wall of the connection member for mounting the upper electrode member therein. The upper electrode member is inserted into the holding groove by the insulation member. An upper portion of an outer wall of the main body is recessed so as to form a circular locating step for engaging the inner wall of the connection end of the sleeve and being pressed against the end of the connection end of the sleeve.

Herein, the atomization device includes an atomizer and an atomization cup. The atomizer includes an electric heater coil and a fiber member for supporting the electric heater coil and absorbing and storing the cigar liquid. The atomization cup includes a cylindrical cup body with an atomization chamber defined therein and a holding base disposed at one end of the cup body for holding the fiber member in place. Gaps are formed at two sides of the holding base through which smoke produced inside the atomization chamber enters into the venting slots of the sleeve.

Here, the absorption stem further includes a paper layer sleeved on the outside of the sleeve and connection component and made of soft material for decorative purposes or attaching a trademark thereon.

Herein, the soft material is ethylene-vinyl acetate copolymer or Polyurethane foam material.

The present invention also provides an electronic cigarette including an absorption stem and a power source stem. The absorption stem is a soft absorption stem as described above. The power source stem is detachably connected with the connection end of the soft absorption stem.

The soft absorption stem of an electronic cigarette of the invention has the following advantages. Both the sleeve and paper layer wrapped at outside of the sleeve are made of soft rubber material, thus leading to better touching feeling when held it in hand. The mouthpiece end of the sleeve is soft and is capable of being contained in mouth, thereby resulting in better touch feeling when containing it in mouth and also resulting in real experience as if a cigar were used. The absorption stem has good simulation effect. A plurality of venting slots is defined in the inner wall of the sleeve. The venting slots are communicated with the venting portion of the upper cover of the cigar liquid tank such that communication with the suction hole of the sleeve is realized. Smoke produced by atomization flows into the venting slots from the atomization chamber of the atomization cup through the gaps between the holding base of the atomization cup and sleeve and then flows out of the sleeve or into the mouth of the smoker from the venting portion through the suction hole. Due to unique smoke path, within relatively unchanged space, there is no need for dedicatedly providing a venting tube operating as the smoke path at the middle position of the cigar liquid tank, hence rendering the internal construction of the sleeve more compact, making the effective cigar liquid storage capacity increased, and improving cigar liquid storage capacity.

The embodiments of the invention will be described in further detail in conjunction with the accompanying drawings.

DETAILED DESCRIPTION OF THE INVENTION

Figure 1:
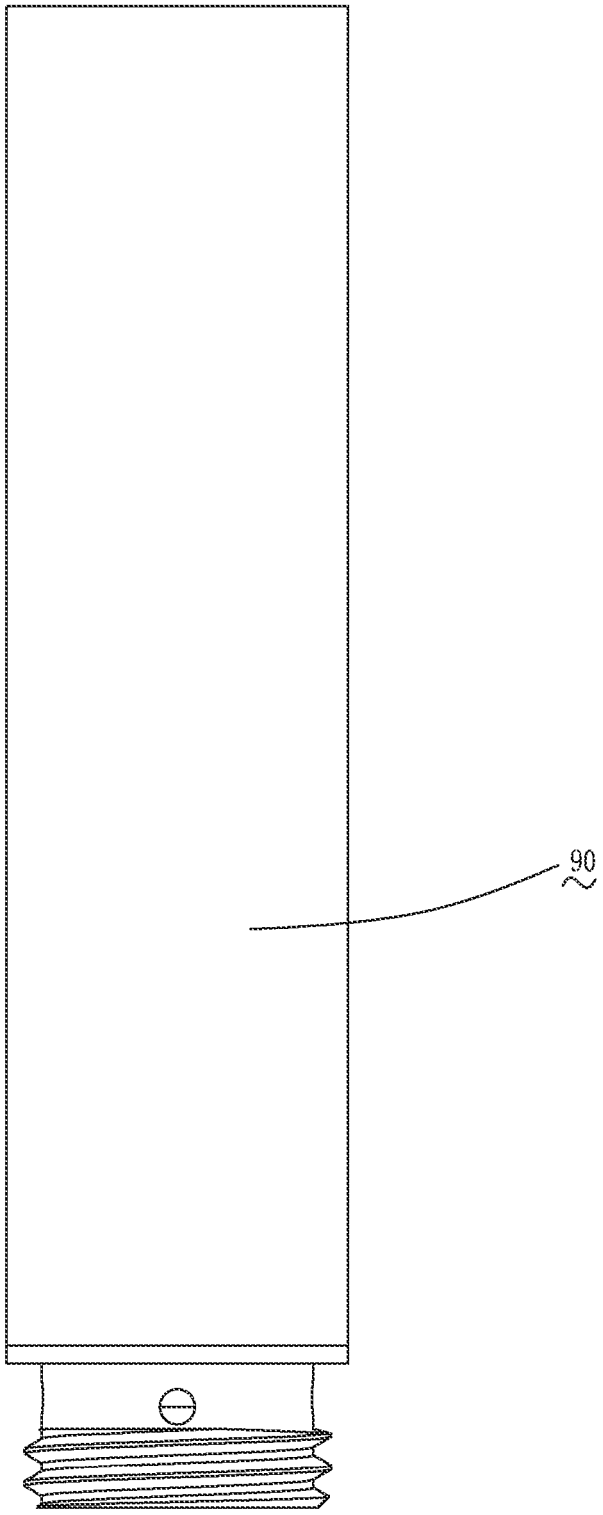
FIG. 1 is a front view of a soft absorption stem of an electronic cigarette of an embodiment of the invention.

It is noted that, in case no interference is resulted in, the embodiments and features contained therein may be combined with each other. The present invention is described in greater detail in conjunction with the accompanying drawings and embodiments.

As shown in FIGS. 1-12, the present invention provides an electronic cigarette soft absorption stem 90 including a sleeve 1, an atomization device 2, a cigar liquid tank 3, a connection component 4, a liquid guiding component 5 and a paper layer 6. The atomization device 2, cigar liquid tank 3 and liquid guiding component 5 are contained inside the sleeve 1. For purposes of description, direction shown in FIG. 2 will be referred hereinafter.

Figure 2:
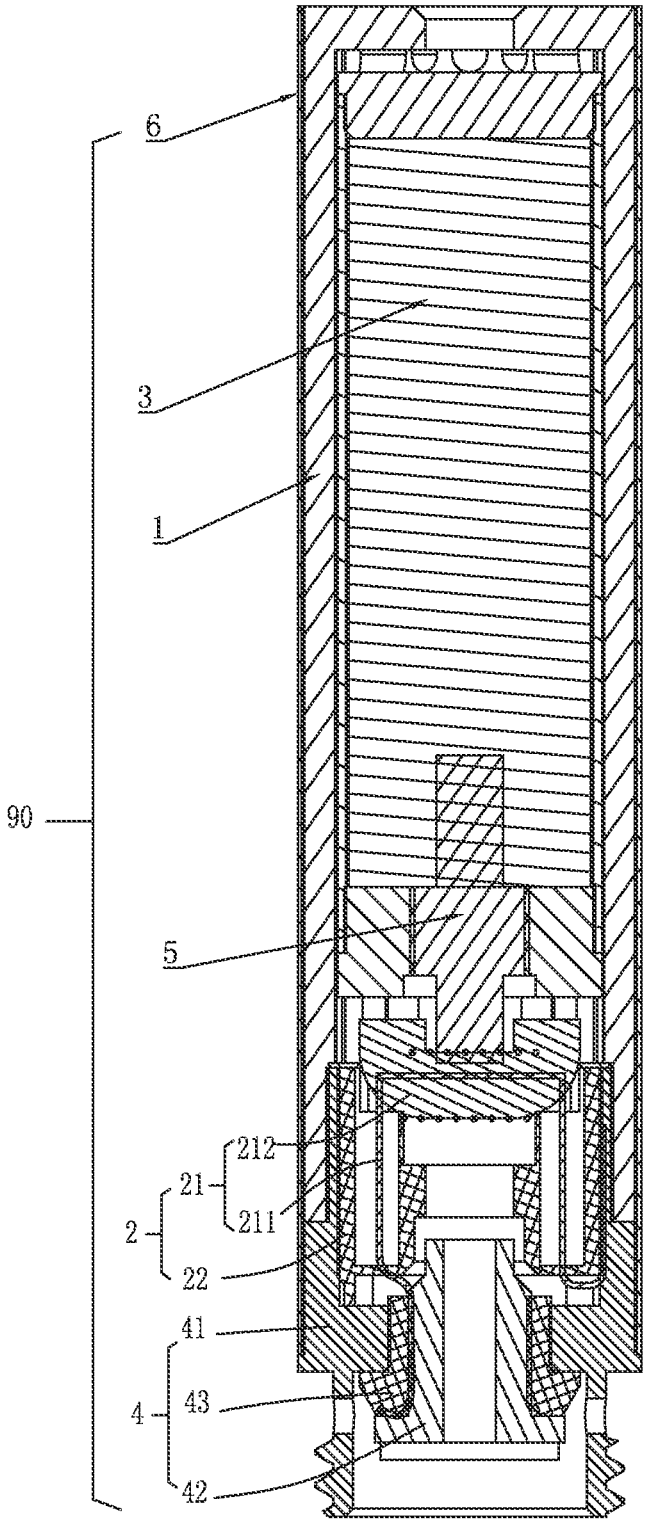
FIG. 2 is a cross-sectional view of a soft absorption stem of an electronic cigarette of an embodiment of the invention.
Figure 3:
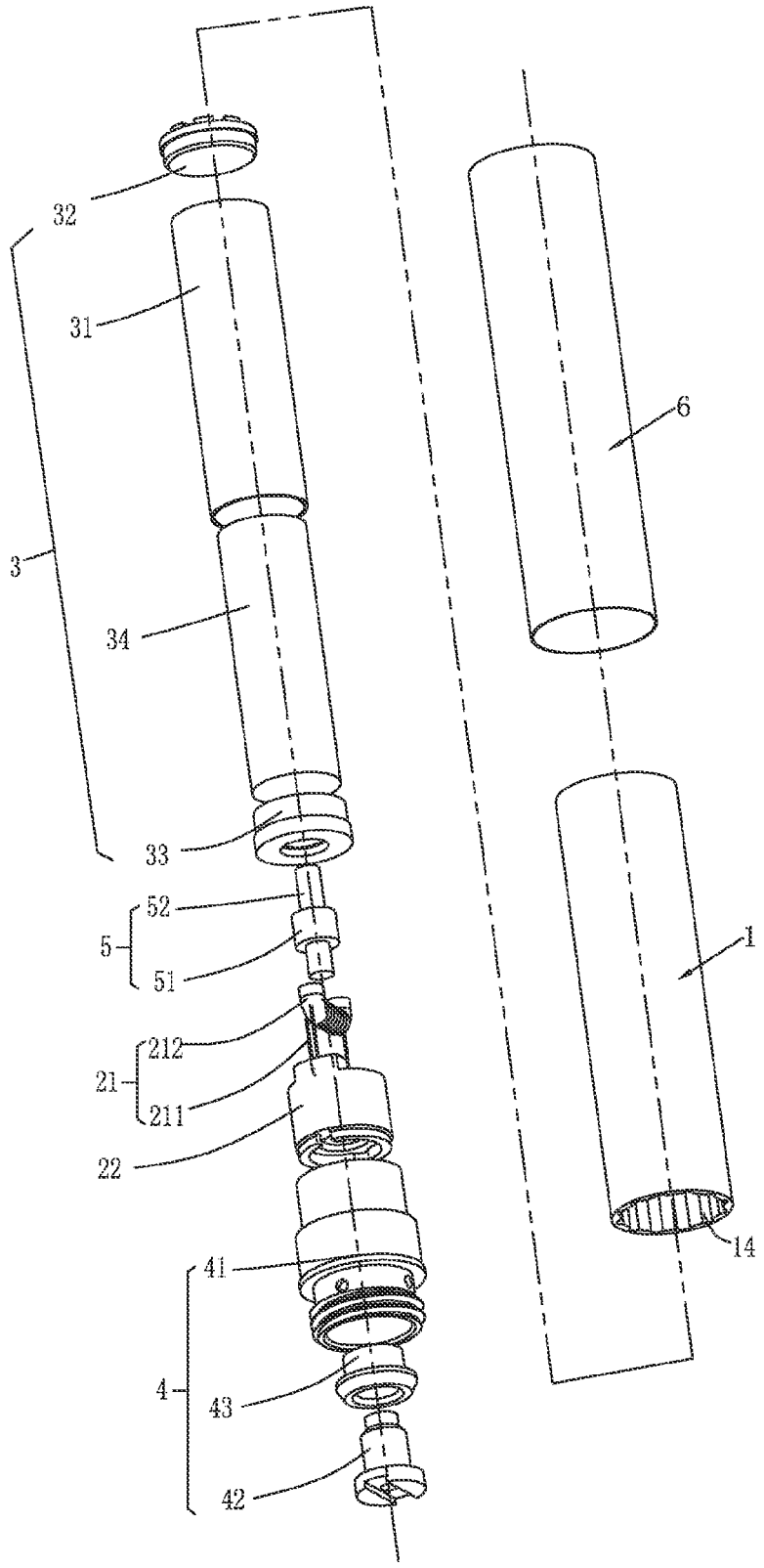
FIG. 3 is an exploded view of a soft absorption stem of an electronic cigarette of an embodiment of the invention.
Figure 4:
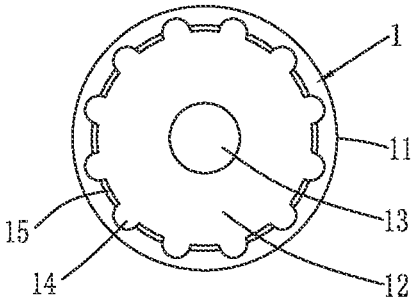
FIG. 4 is a bottom plan view of a sleeve of a soft absorption stem of an electronic cigarette of an embodiment of the invention.
Figure 5:
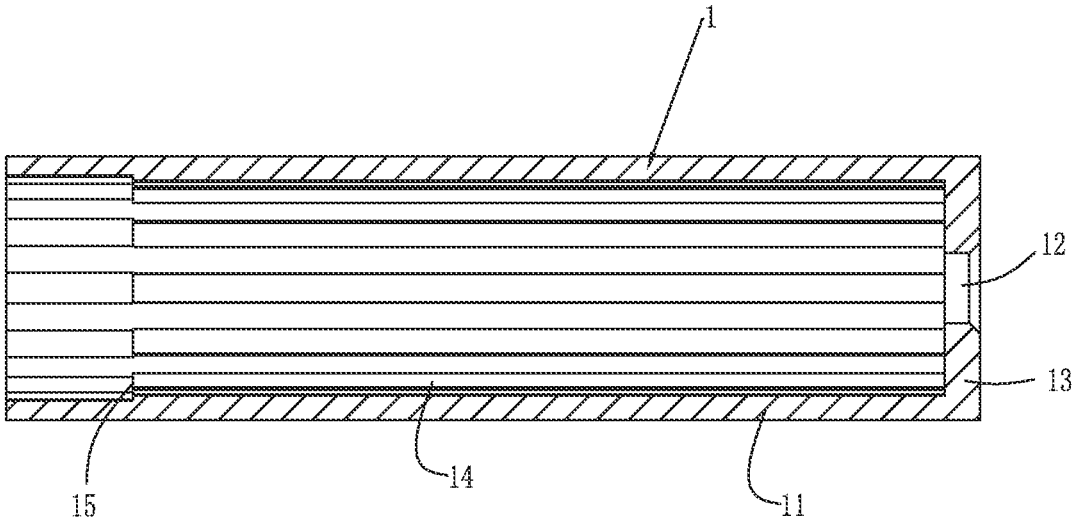
FIG. 5 is a cross-sectional view of a sleeve of a soft absorption stem of an electronic cigarette of an embodiment of the invention.

As shown by FIGS. 2-4, the sleeve 1 is of a cylinder and includes a side wall 11, a top wall 12 and a hollow cavity defined collectively by the side wall 11 and top wall 12. A mouthpiece end and a connection end for connecting with a power source stem 95 are disposed at two ends of the sleeve respectively. The top wall 12 is located at the mouthpiece end, and a suction hole 13 is defined in the top wall 12. Plural venting slots 14 is formed in an inner wall of the sleeve 1 and is extended axially from one end surface to the other end surface of the sleeve 1. The venting slots 14 are arranged circumferentially. Therefore, the cross section of the sleeve 1 takes on polygon or circular shape. The venting slots 14 have a cross section of arc shape, U shape, V shape or trapezoid shape. The venting slots 14 are formed by recessing of edges of the polygon or circle in a direction away from the circle center. An outer wall of the connection end of the sleeve 1 is recessed so as to form a circular locating step 15. The locating step 15 has no influence on presence and function of the venting slots 14. The sleeve 1 is constructed of soft material which may be plastic, paper, rubber silica gel or fiber material. Herein, the plastic material is selected from any one of the following materials: PC, PP, PVC, ABS, PET or PE. Herein, the paper material is paper having required hardness for example food package paper, bond paper, fiber paper, coated paper or brown paper. Here, the fiber material is fiber tube, wood pulp fiber or glass fiber tube. It is understandable that some changes may be made to the sleeve 1 of the embodiment (these changes are not shown). A number of protrusions circumferentially distributed on the inner wall of the sleeve 1 may replace the venting slots 14. The cross section of the protrusions may also take on arc shape, U shape, V shape or trapezoid shape. These protrusions are formed by protruding of the inner wall of the sleeve 1 towards the axis of the sleeve 1. Recesses with the same function as the venting slots 14 may also be defined in gaps between the protrusions and inner wall.

Figure 11:
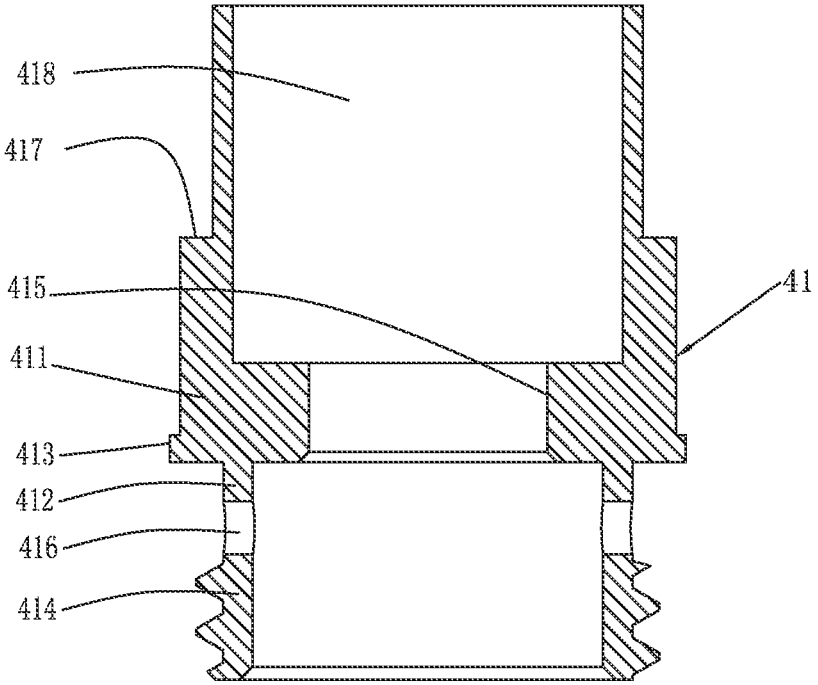
FIG. 11 is a cross-sectional view of a connection member of a connection component of a soft absorption stem of an electronic cigarette of an embodiment of the invention.

Herein, a connection component 4 is provided on the connection end of the sleeve 1 for connecting with the power source stem 95. The connection component 4 includes a connection member 41 which functions as a first electrode (for example the negative electrode) of the atomization device 2, an upper electrode member 42 working as a second electrode (for example the positive electrode) of the atomization device 2, and an insulation member 43 for insulating the connection member 41 from the upper electrode 42. As shown in FIG. 11, the connection member 41 is substantially of a hollow cylinder and includes a cylindrical main body 411 with a larger diameter and a cylindrical connection portion 412 with a smaller diameter. A locating rim 413 is disposed between the main body 411 and connection portion 412 and extends radially outwardly from the main body 411 for matching the connection end of the sleeve 1. The main body 411 is inserted and secured into the sleeve 1. An externally threaded connector 414 for connecting with the power source stem 95 and an intake hole 416 for air entrance are disposed on the connection portion 412. A holding groove 415 is defined in an inner wall of the connection member 41 for mounting the upper electrode member 42 therein. The upper electrode member 42 is inserted into the holding groove 415 by the insulation member 43. An upper portion of an outer wall of the main body 411 is recessed so as to form a circular locating step 417 for engaging the inner wall of the connection end of the sleeve 1 and for being pressed against the end of the connection end of the sleeve 1. A cavity 418 defined in the main body 411 is intended for receiving an atomization cup 22 of the atomization device 2 which will be described next. A middle portion of the upper electrode 42 has a venting through hole defined therein.

As shown in FIGS. 2, 3, 6, 7 and 12, the atomization device 2 includes an atomizer 21, an atomization cup 22, an atomizer control circuit board 23 and a retention base 24 for holding the circuit board. The atomizer 21 includes an electric heater coil 211 and a fiber member 212 for supporting the electric heater coil 211 and absorbing the cigar liquid. The electric heater coil 211 is enwound on the fiber member 212 and is held in the atomization cup 22 with the help of the fiber member 212. The fiber member 212 functions to absorb cigar liquid and pass the liquid to the electric heater coil 211 such that the cigar liquid is atomized to produce smoke. The fiber member 212 is made of glass fiber material of rope or cylinder form. In this embodiment, the fiber member 212 is of a U shape, and is pressed against the liquid guiding component 5 in order that the cigar liquid soaks it from the liquid guiding component 5. The atomizer control circuit board 23 and retention base 24 are arranged in the power source stem 95.

Figure 6:
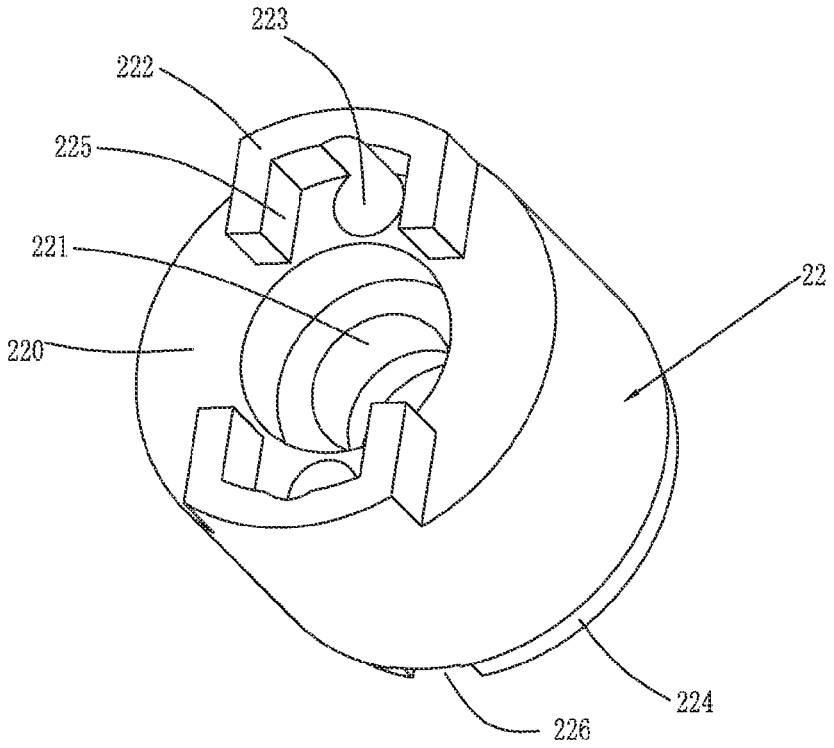
FIG. 6 is a perspective view of an atomization cup of a soft absorption stem of an electronic cigarette of an embodiment of the invention.
Figure 7:
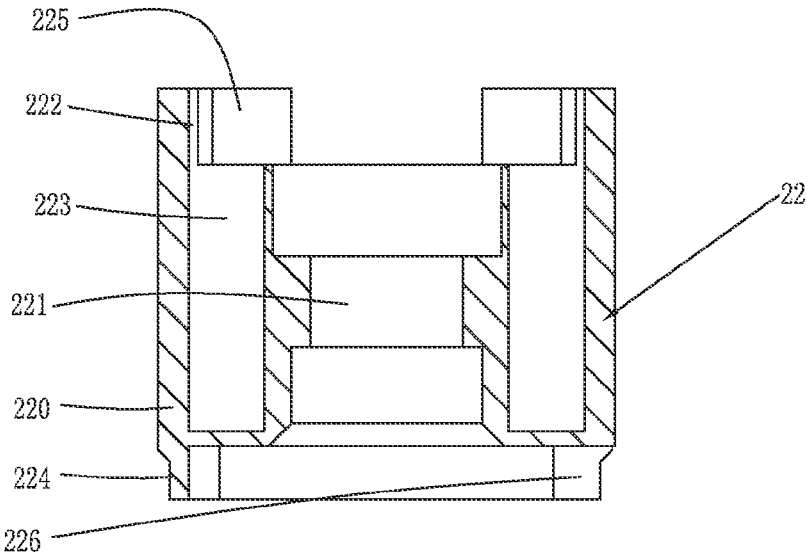
FIG. 7 is a cross-sectional view of an atomization cup of a soft absorption stem of an electronic cigarette of an embodiment of the invention.
Figure 8:
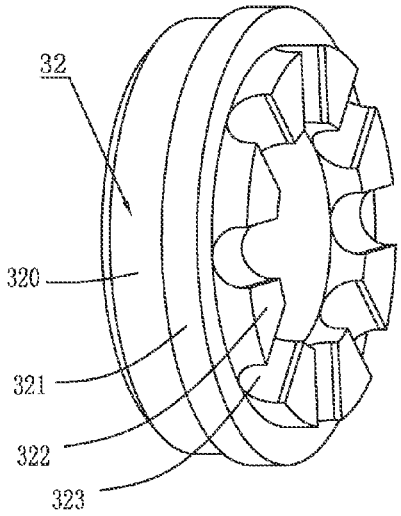
FIG. 8 is a perspective view of an upper cover of a cigar liquid tank of a soft absorption stem of an electronic cigarette of an embodiment of the invention.
Figure 9:
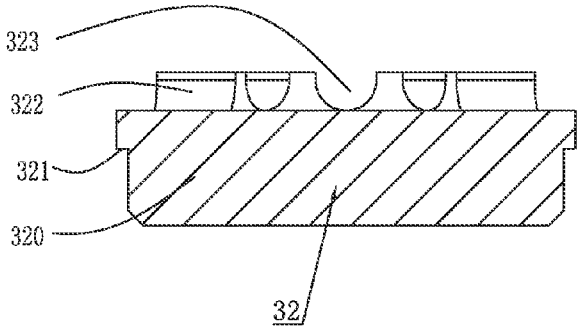
FIG. 9 is a cross-sectional view of an upper cover of a cigar liquid tank of a soft absorption stem of an electronic cigarette of an embodiment of the invention.
Figure 10:
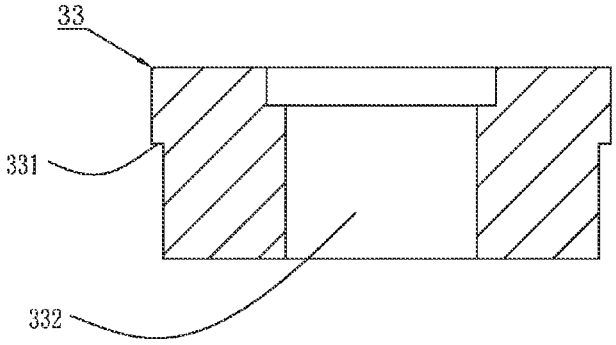
FIG. 10 is a cross-sectional view of a lower cover of a cigar liquid tank of a soft absorption stem of an electronic cigarette of an embodiment of the invention.

As shown in FIGS. 6-7, the atomization cup 22 is of a cylinder and includes a cup body 220 with an atomization chamber 221 and a wire guiding hole 223 defined therein, a holding base 222 disposed at two sides of the cup body 220 and a supporting platform 224. The atomization chamber 221 is a through hole running axially across the cup body 220 and is intended for storing smoke generated by atomization of the cigar liquid by the atomizer 21, and is also used as a heat dissipation path for dissipating heat generated by the atomizer 21 and also functions to pass gas into the atomization cup 22. A protrusion is formed by extension of the holding base 222 from an upper surface of the cup body 220 outwardly to a suitable height. A holding groove 225 is defined in the holding base 222 for holding the atomizer 21 in place. The holding base 222 with the holding groove 225 is of a U shape. The fiber member 212 is fixed into the groove 225 of the holding base 222, thus resulting in convenient installation of the member 212. Gaps are formed in advance at two sides of the holding base 222 through which smoke produced inside the atomization chamber 221 enters into the venting slots 14 of the sleeve 1. A side wall of the supporting platform 224 is provided a notch 226 for passing through the electric heater coil. The wire guiding hole 223 is used for passing through the electric heater coil 211 and it extends across the two ends of the atomization cup 22. There are two wire guiding holes 223 in this embodiment. The electric heater coil 211 is enwound on the fiber member 212. One end of the electric heater coil 211 travels across the wire guiding hole 223, then passes through a bottom wall of the atomization cup 22 after being curved at a first time, and finally is electrically connected with the connection member 41 after being curved at a second time. It is tightly sandwiched between the inner wall of the connection member 41 and outer wall of the atomization cup 22 by mutual pressure between the atomization cup 22 and connection member 41, thus realizing electrical connection with the connection member 41. The other end of the electric heater coil 211 passes through another wire guiding hole 223 and then is connected with the upper electrode 42 electrically. It is tightly sandwiched between an outer wall of the upper electrode 42 and an inner wall of the insulation member 43 due to mutual pressure between the insulation member 43 and upper electrode 42, realizing electrical connection with the upper electrode 42. The electrical connection is performed by above pressure manner without welding process, thus simplifying the process and leading to convenient mounting. A lower end of the atomization cup 22 is engaged with the inner wall of the connection member 41 so that the electric heater coil 211 is tightly pressed. In this embodiment, the atomization cup 22 may be made of material with good heat resistance such as silica gel such that the atomization cup 22 bears better heat isolation effect. In this embodiment, the atomization cup 22 not only simplifies manufacture process of the electronic cigarette absorption stem 90, but also facilitates installation of the atomizer 21. Furthermore, the atomization cup 22 also has better heat isolation effect given its better heat resistant silica gel material. In use, the outer wall of the sleeve 1 will have low temperature and will not scald the hands or mouth of the user.

As shown in FIGS. 2, 3, 8-10, the cigar liquid tank 3 is disposed in the sleeve 1. In this embodiment, the cigar liquid tank 3 is defined by a cylindrical space formed collectively by a liquid barrel 31 for storing cigar liquid and an upper cover 32 and a lower cover 33 both of which are disposed respectively at two ends of the liquid barrel 31. The upper cover 32 and lower cover 33 are inserted into the liquid barrel 31 and hermetically coupled with the liquid barrel 31. The outer wall of the liquid barrel 31 is pressed or almost pressed against the inner wall of the sleeve 1. The two ends of the cigar liquid are connected with the sleeve. The upper cover 32 is pressed against the top wall of the sleeve 1, while the lower cover 33 is pressed against the holding base 222 of the atomization cup 22. The cigar liquid tank 3 takes large space of the sleeve 1. In addition, there is no need to insert a venting tube operating as a smoke path into a middle portion of the cigar liquid tank 3 along its axis. By this manner, the effective cigar liquid storage capacity of it is correspondingly increased. Herein, the liquid barrel 31 is of a cylinder and is made of soft rubber. The upper cover 32 includes a cylindrical upper cover body 320, an upper cover bulged rim 321, which is extended radially outwardly along the side wall of the upper cover body 320 at one end thereof and is pressed against one end of the liquid barrel 31, and a venting portion 322 located at an upper end of the upper cover body 320 for communicating the venting slots 14 with the suction hole 13. The venting portion 322 is a cylindrical protrusion formed by extending from an upper end surface of the upper cover body 320 along the axial direction to a certain height. A plurality of guiding notches 323, which is extended radially and arranged circumferentially, is defined in the side wall of the venting portion 322, thus communicating the interior and exterior of the venting portion 322. The venting portion 322 has a cavity of which an opening faces the suction hole 13 of the sleeve 1. The lower cover 33 is of a cylinder and a lower cover bulged rim 331 is provided on the side wall of the lower cover 33 at a bottom end thereof for being pressed against the other end of the liquid barrel 31. A sealing hole 332 extended axially is defined at a middle portion of the lower cover 33. The sealing hole 332 has the liquid guiding component 5 accommodated therein to seal the cigar liquid tank 3. In this embodiment, the cigar liquid tank 3 is filled with solid cigar liquid 34.

As shown in FIGS. 2-3, the liquid guiding component 5 is used for guiding cigar liquid contained in the tank 11 to the atomization cup 22 for atomization of the liquid. The liquid guiding component 5 includes a liquid isolating member 51 and a liquid guiding member 52. The cigar liquid soaks in the cigar liquid tank 11 and then absorbed and stored in the liquid guiding member 52. The liquid isolating member 51 matches the sealing hole 332 of the lower cover 33. A fixation hole is extended axially inside the liquid isolating member 51 for clasping and securing the liquid guiding member. The liquid isolating member 51 is made of silica gel or foam nickel. The liquid guiding member 52 functions to absorb the cigar liquid coming from the liquid isolating member 51 by penetration and is made of high temperature resistant cotton, glass fiber cotton or thick cotton. The liquid guiding member 52 can absorb and store water just like sponge such that cigar liquid slowly soaks into the atomization cup 22. The liquid guiding member 52 is of a cylinder and is tightly pressed against the fixation hole of the liquid isolating member 51 by tight contact of the side wall thereof with the fixation hole. One end of the liquid guiding member 52 extends into the cigar liquid tank 3 for absorption of cigar liquid, and the other end thereof is pressed against the fiber member 212. The fiber member 212 absorbs the cigar liquid coming from the liquid guiding member 52 so that the electric heater coil 211 will heat the liquid to atomize Using the liquid guiding component 5, the assembling of the electronic cigarette absorption stem 90 will become more convenient, liquid guiding effect will be improved, and leakage of the cigar liquid out of cigar liquid tank 11 will be prevented.

As shown in FIGS. 1-3, the paper layer 6 is of a cylinder shape, wrapped at the outer walls of the sleeve 1 and connection member 41, and is pressed against the locating bulged rim of the connection member 41. The paper layer is decorative or is used for attaching a trademark on the absorption stem 90. The paper layer is constructed of airtight soft rubber material, such as ethylene-vinyl acetate copolymer or Polyurethane foam material.

During assemble process, the venting portion of the upper cover 32 of the cigar liquid tank 3 is pressed against the top wall of the sleeve 1 such that the venting portion of the upper cover 32 communicates the suction hole 13 of the sleeve 1. The fiber member 212 of the atomizer is mounted and held in the holding base of the atomization cup, and the atomization cup 22 is secured in the cavity of the connection member 41. As such, the positive and negative electrodes of the electric heater coil are electrically coupled with the upper electrode 42 and connection member 41 respectively due to extrusion, ensuring that one end of the liquid guiding member goes into the cigar liquid tank 3 while the other end is being pressed against the fiber member 212.

Figure 12:
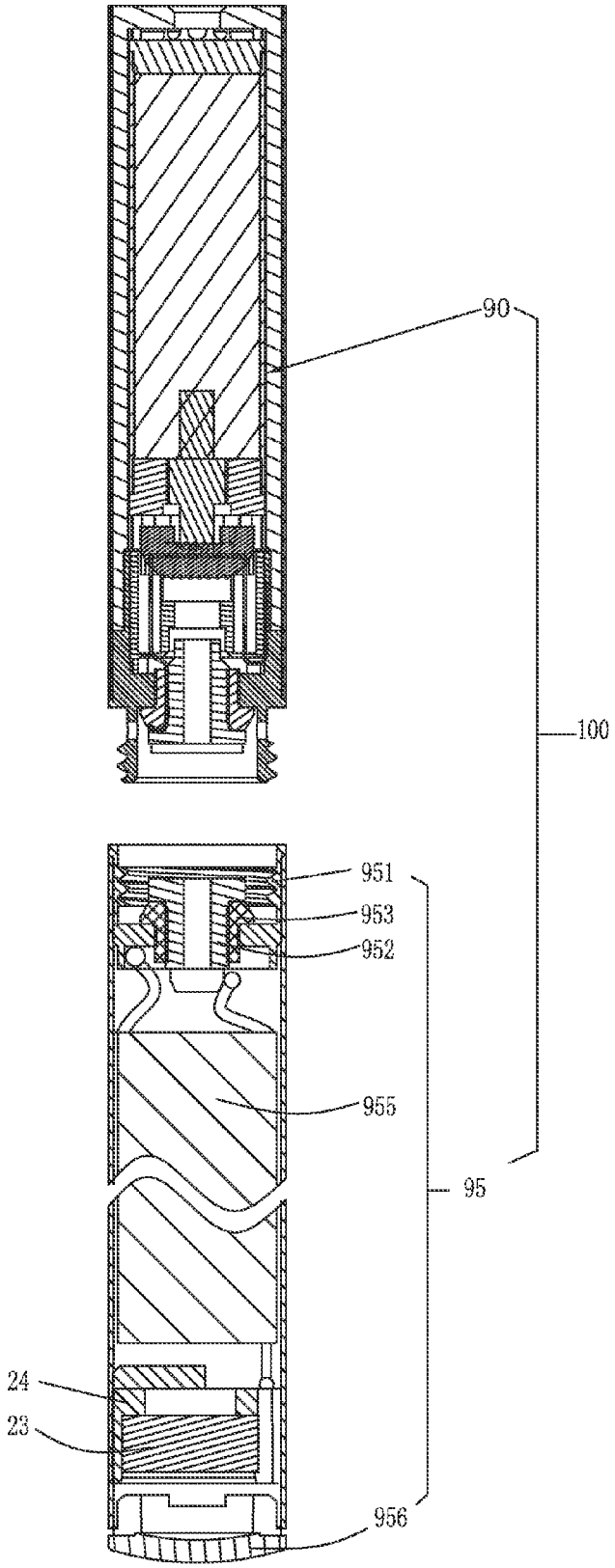
FIG. 12 is a cross-sectional view of an electronic cigarette according to an embodiment of the invention.

As shown in FIG. 12, the present invention provides an electronic cigarette 100 including a soft absorption stem 90 as described above and a power source stem 91. The soft absorption stem 90 and power source stem 91 are connected with each other by means of snapping, inserting or screw. In this embodiment, they are connected by screw.

The power source stem 95 is of substantially a cylinder. One end of the stem 95 connected with the absorption stem 91 is provided with an internally threaded connector 951 engaged the externally threaded connector of the connection member. A lower electrode 952, which is pressed against the upper electrode 14 so as to form a closed electric circuit, is disposed in the connector 951. The lower electrode 952 is held in the internally threaded connector 951 by an insulation jacket 953. A venting through hole extended axially is defined in a middle position of the lower electrode 952. The internally threaded connector 951 and lower electrode 952 function as first and second electrodes of the power source stem 95 respectively. Battery 955 and the like are contained in the power source stem 95. The first and second electrodes of the battery 955 are respectively electrically connected with the internally threaded connector 951 and lower electrode 952. The other end of the power source stem 95 is provided with a base cover 956 on which an indicator light and an intake hole (not shown) are provided.

Moreover, as shown in FIG. 12, external air enters into the power source stem 95 through the intake hole of the base cover 956 of the power source stem 95, then enters into the atomization chamber 221 of the atomization cup 22 via the intake holes of the lower electrode 952 and upper electrode 42, next enters into the venting slots 14 on the side wall of the sleeve 1 through the gaps at side wall of the holding base 222, afterward enters into the venting portion 322 of the upper cover 32 of the cigar liquid tank 3, and finally flows out of the absorption stem 90 via the suction hole 13 of the sleeve 1. As a result, a unique air path is formed inside the electronic cigarette, and the electronic cigarette communicates external air smoothly. Of course, external air may also enter into the upper electrode post 42 from the gaps between the absorption stem 90 and power source stem 95 through the intake hole 416 of the connection member 41. Before operation of the electronic cigarette, small amount of cigar liquid in the tank 11 soaks through the liquid guiding member 52 and is stored in the fiber member 212. During operation, the electric heater coil 211 of the atomization device 2 works to generate heat such that the cigar liquid stored in the fiber member 212 is heated and changed to smoke. The smoke travels across the venting slots 14 in the side wall of the sleeve 1 by the gaps in side wall of the holding base 222 from the atomization chamber 221, and with the help of the venting portion 322 of the upper cover 32, is finally absorbed by the smoker via the suction hole 13 of the sleeve 1.

Though various embodiments of the invention have been illustrated above, a person of ordinary skill in the art will understand that, variations and improvements made upon the illustrative embodiments fall within the scope of the invention, and the scope of the invention is only limited by the accompanying claims and their equivalents.

The invention claimed is:

1. A soft absorption stem for an electronic cigarette, comprising a sleeve with a hollow cavity, a cigar liquid tank disposed inside the sleeve for storing cigar liquid, an atomization device for transforming cigar liquid into smoke, and a liquid guiding component for guiding cigar liquid contained in the tank to the atomization device, wherein the sleeve is made of soft material; a plurality of venting slots is extended axially from one end of the sleeve to the other end thereof and disposed on an inner wall of the sleeve; the sleeve includes a mouthpiece end and a connection end; a suction hole communicating with the venting slots is provided on the mouthpiece end; smoke produced by atomization of the atomization device flows out of the sleeve from the venting slots across the suction hole;

a connection component is provided on the connection end of the sleeve for connecting with an external power source in order to provide power to the atomization device and thus make the device work; the connection component is inserted into the sleeve so as to secure the atomization device, liquid guiding component and cigar liquid tank inside the sleeve; the connection component includes a connection member which functions as a first electrode of the atomization device and of which one end is inserted into the sleeve for securing the atomization device inside the sleeve, an upper electrode member working as a second electrode of the atomization device, and an insulation ring located between the upper electrode and connection member; and the upper electrode member is tightly fastened inside the connection member through the insulation ring;

the connection member is substantially of a hollow cylinder and includes a cylindrical main body with a larger diameter and a cylindrical connection portion with a smaller diameter; a locating rim is disposed between the main body and connection portion and extends radially outwardly from the main body for matching the connection end of the sleeve; the main body is inserted and secured into the sleeve; an externally threaded connector for connecting with an external power source and an intake hole for air entrance are disposed on the connection portion; a holding groove is defined in the inner wall of the connection member for mounting the upper electrode member therein; the upper electrode member is inserted into the holding groove by the insulation member; an upper portion of an outer wall of the main body is recessed so as to form a circular locating step for engaging the inner wall of the connection end of the sleeve and being pressed against the end of the connection end of the sleeve; and the cavity of the main body is used for receiving the atomization device.

2. The absorption stem according to claim 1, wherein the venting slots are formed by recessing of the inner wall of the sleeve in a direction away from an axis; and the plurality of venting slots is symmetrical circumferentially about the axis of the sleeve and is arranged on the inner wall of the sleeve.

3. The absorption stem according to claim 1, wherein the cross section of the inner wall of the sleeve is of a circular or polygon; and the venting slots have a cross section of arc shape, U shape, V shape or trapezoid shape.

4. The absorption stem according to claim 1, wherein the soft material is plastic, paper, rubber or fiber material; the plastic material is selected from any one of the following materials: PC, PP, PVC, ABS, PET or PE; the paper material is paper having required hardness; and the fiber material is fiber tube, wood pulp fiber or glass fiber tube.

5. The absorption stem according to claim 1, wherein the sleeve is formed by combination of a top wall and a side wall; the top wall is located at the mouthpiece end and is integrally formed with the sleeve; and the suction hole is defined in the top wall.

6. The absorption stem according to claim 1, wherein a venting portion is placed between the suction hole and venting slots for interconnecting the two.

7. The absorption stem according to claim 6, wherein the venting portion is a cylinder positioned on an upper end of the cigar liquid tank; the cavity of the venting portion communicates the suction hole; a guiding slot running axially is disposed on a side wall of the venting portion to communicate the cavity of the venting portion with the venting slots.

8. The absorption stem according to claim 1, wherein the cigar liquid tank is defined by a sealed cylindrical space constituted by a liquid barrel for storage of cigar liquid and an upper cover and a lower cover both of which are sealably disposed at two ends of the barrel; the side wall of the cigar liquid tank is pressed or almost pressed against the inner wall of the sleeve; and the two ends of the cigar liquid tank are connected with the sleeve.

9. The absorption stem according to claim 8, wherein the liquid barrel is of a cylinder, and the upper cover and lower cover are inserted into the inner wall of the liquid barrel at two ends thereof respectively; the upper cover includes a cylindrical upper cover body, an upper cover bulged rim, which is extended radially outwardly along the side wall of the upper cover body at one end thereof and is pressed against one end of the liquid barrel, and a venting portion located at an upper end of the upper cover body for communicating the venting slots with the suction hole; the lower cover is of a cylinder and a lower cover bulged rim is provided on the side wall of the lower cover at a bottom end thereof for being pressed against the other end of the liquid barrel; a sealing hole extended axially is defined at a middle portion of the lower cover; and the sealing hole has the liquid guiding component accommodated therein to seal the cigar liquid tank.

10. The absorption stem according to claim 1, wherein the atomization device includes an atomizer and an atomization cup; the atomizer includes an electric heater coil and a fiber member for supporting the electric heater coil and absorbing and storing the cigar liquid; the atomization cup includes a cylindrical cup body with an atomization chamber defined therein and a holding base disposed at one end of the cup body for holding the fiber member in place; and gaps are formed at two sides of the holding base through which smoke produced inside the atomization chamber enters into the venting slots of the sleeve.

11. The absorption stem according to claim 1, wherein the absorption stem further includes a paper layer sleeved on the outside of the sleeve and connection component and made of soft material for decorative purposes or attaching a trademark thereon.

12. The absorption stem according to claim 11, wherein the soft material is ethylene-vinyl acetate copolymer or Polyurethane foam material.

13. An electronic cigarette comprising an absorption stem and a power source stem, wherein the absorption stem is a soft absorption stem according to claim 1, and the power source stem is detachably connected with the connection end of the soft absorption stem.

14. An electronic cigarette, comprising a sleeve with a hollow cavity, a cigar liquid tank disposed inside the sleeve for storing cigar liquid, an atomization device for transforming cigar liquid into smoke, and a liquid guiding component for guiding cigar liquid contained in the tank to the atomization device, wherein a plurality of venting slots is extended axially from one end of the sleeve to the other end thereof and disposed on an inner wall of the sleeve; the sleeve includes a mouthpiece end and a connection end; a suction hole communicating with the venting slots is provided on the mouthpiece end; smoke produced by atomization of the atomization device flows out of the sleeve from the venting slots across the suction hole;

a connection component is provided on the connection end of the sleeve for connecting with an external power source in order to provide power to the atomization device and thus make the device work; the connection component is inserted into the sleeve so as to secure the atomization device, liquid guiding component and cigar liquid tank inside the sleeve; the connection component includes a connection member which functions as a first electrode of the atomization device and of which one end is inserted into the sleeve for securing the atomization device inside the sleeve, an upper electrode member working as a second electrode of the atomization device, and an insulation ring located between the upper electrode and connection member; and the upper electrode member is tightly fastened inside the connection member through the insulation ring;

the connection member is substantially of a hollow cylinder and includes a cylindrical main body with a larger diameter and a cylindrical connection portion with a smaller diameter; a locating rim is disposed between the main body and connection portion and extends radially outwardly from the main body for matching the connection end of the sleeve; the main body is inserted and secured into the sleeve; an externally threaded connector for connecting with an external power source and an intake hole for air entrance are disposed on the connection portion; a holding groove is defined in the inner wall of the connection member for mounting the upper electrode member therein; the upper electrode member is inserted into the holding groove by the insulation member; an upper portion of an outer wall of the main body is recessed so as to form a circular locating step for engaging the inner wall of the connection end of the sleeve and being pressed against the end of the connection end of the sleeve; and the cavity of the main body is used for receiving the atomization device.

* * * * *